US012796736B2

(12) United States Patent
Emmett et al.

(10) Patent No.: US 12,796,736 B2
(45) Date of Patent: Nov. 17, 2026

(54) HEATER ASSEMBLY FOR USE IN AN AEROSOL-GENERATING SYSTEM

(71) Applicant: Philip Morris Products S.A., Neuchatel (CH)

(72) Inventors: Robert Emmett, Neuchatel (CH); Eva Saade Latorre, Colombier (CH)

(73) Assignee: Philip Morris Products S.A., Neuchatel (CH)

( * ) Notice: Subject to any disclaimer, the term of this patent is extended or adjusted under 35 U.S.C. 154(b) by 553 days.

(21) Appl. No.: 18/257,790

(22) PCT Filed: Dec. 13, 2021

(86) PCT No.: PCT/EP2021/085511
§ 371 (c)(1),
(2) Date: Jun. 15, 2023

(87) PCT Pub. No.: WO2022/136002
PCT Pub. Date: Jun. 30, 2022

(65) Prior Publication Data

US 2024/0032599 A1 Feb. 1, 2024

(30) Foreign Application Priority Data

Dec. 22, 2020 (EP) ..... 20216453

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/10* (2020.01); *A24F 40/46* (2020.01); *A24F 40/465* (2020.01)

(58) Field of Classification Search
CPC ..... A24F 40/10; A24F 40/42
See application file for complete search history.

(56) References Cited

U.S. PATENT DOCUMENTS

2013/0081623 A1 4/2013 Buchberger
2016/0007652 A1 1/2016 Taluskie et al.
(Continued)

FOREIGN PATENT DOCUMENTS

CA 3 058 163 A1 10/2018
CN 203986062 U 12/2014
(Continued)

OTHER PUBLICATIONS

Glycerin, National Institute of Standards and Technology, https://webbook.nist.gov/cgi/cbook.cgi?ID=C56815&Mask=4#Thermo-Phase. Date accessed: Dec. 16, 2025 (Year: 2025).*
(Continued)

*Primary Examiner* — Michael H. Wilson
*Assistant Examiner* — Stephanie Lynn Moore
(74) *Attorney, Agent, or Firm* — Oblon, McClelland, Maier & Neustadt, L.L.P.

(57) ABSTRACT

A heater assembly for an aerosol-generating system is provided, the heater assembly including: a retention material containing an aerosol-forming substrate in condensed form, the aerosol-forming substrate including first and second compounds, the second compound having a higher boiling point than the first compound; at least one airflow path defined through the retention material; and at least one heating element shaped to define an interior volume filled with the retention material and having a cross-sectional area that decreases along a longitudinal axis, the at least one airflow path passes through a first central region of the interior volume and a second central region of the interior volume, the first and the second central regions being spaced-apart along the longitudinal axis, and a resistance of the at least one heating element increasing along the longitudinal axis in a same direction that the cross-sectional area of the interior volume decreases.

14 Claims, 6 Drawing Sheets

(51) Int. Cl.
*A24F 40/46* (2020.01)
*A24F 40/465* (2020.01)

(56) References Cited

U.S. PATENT DOCUMENTS

| | | | | |
|---|---|---|---|---|
| 2016/0044966 | A1 | 2/2016 | Li et al. | |
| 2018/0255831 | A1 | 9/2018 | Lipowicz et al. | |
| 2018/0279672 | A1 | 10/2018 | Davis et al. | |
| 2018/0289067 | A1* | 10/2018 | Courbat | A24F 40/44 |
| 2018/0332897 | A1 | 11/2018 | Taluskie et al. | |
| 2018/0352862 | A1 | 12/2018 | Mironov et al. | |
| 2019/0045834 | A1 | 2/2019 | Fuisz et al. | |
| 2020/0268051 | A1 | 8/2020 | Davis et al. | |
| 2021/0030073 | A1 | 2/2021 | Yang et al. | |
| 2021/0084978 | A1 | 3/2021 | Taluskie et al. | |
| 2021/0360971 | A1 | 11/2021 | Lipowicz et al. | |

FOREIGN PATENT DOCUMENTS

| | | | |
|---|---|---|---|
| CN | 104824853 | A | 8/2015 |
| CN | 204608210 | U | 9/2015 |
| CN | 105011376 | A | 11/2015 |
| CN | 105264096 | A | 1/2016 |
| CN | 110279162 | A | 9/2019 |
| CN | 111031820 | A | 4/2020 |
| EA | 031314 | B1 | 12/2018 |
| EP | 2 984 952 | A1 | 2/2016 |
| EP | 3 166 431 | | 5/2017 |
| EP | 2 519 121 | B1 | 6/2017 |
| EP | 3 319 464 | | 5/2018 |
| EP | 3 478 104 | | 5/2019 |
| JP | 2013-521075 | A | 6/2013 |
| JP | 2017-522868 | A | 8/2017 |
| JP | 2017-525342 | A | 9/2017 |
| JP | 2019-522982 | A | 8/2019 |
| JP | 2020-511989 | A | 4/2020 |
| JP | 2020-522236 | A | 7/2020 |
| KR | 10-2019-0127941 | | 11/2019 |
| RU | 2 608 277 | C2 | 1/2017 |
| RU | 2 732 423 | C2 | 9/2020 |
| TJ | 343 | C | 10/2002 |
| UA | 41898 | C2 | 10/2001 |
| WO | WO 2011/109849 | A1 | 9/2011 |
| WO | WO 2015/101479 | A1 | 7/2015 |
| WO | WO 2016/007516 | A1 | 1/2016 |
| WO | WO 2017/161725 | A1 | 9/2017 |
| WO | WO 2018/167066 | A1 | 9/2018 |
| WO | WO 2019/157645 | A1 | 8/2019 |
| WO | WO 2020/064876 | A1 | 4/2020 |
| WO | WO 2021/151927 | A1 | 8/2021 |

OTHER PUBLICATIONS

Propylene Glycol, National Institute of Standards and Technology, https://webbook.nist.gov/cgi/cbook.cgi?ID=C57556&Units=SI&Mask=4#Thermo-Phase. Date accessed: Dec. 16, 2025 (Year: 2025).*

Extended European Search Report issued Jun. 16, 2021 in European Patent Application No. 20216453.9, 8 pages.

International Search Report & Written Opinion issued Apr. 7, 2022 in PCT/EP2021/085511 filed on Dec. 13, 2021, 10 pages.

Combined Russian Office Action and Search Report issued Jun. 2, 2025, in Russian Patent Application No. 2023119153 (with unedited computer-generated English translation), 9 pages.

Russian Notice of Allowance issued Oct. 15, 2025 in Russian Patent Application No. 2023119153/03, 8 pages.

Japanese Office Action issued Dec. 22, 2026, in corresponding Japanese Patent Application No. 2023-536375 (with English Translation), 7 pages.

Office Action and Search Report dated Mar. 21, 2026 issued in corresponding Chinese Patent Application No. 202180081685.5 (with English translation).

Office Action dated Jun. 15, 2026 issued in the corresponding Korean Patent Application No. 2023-7024093 (with translation).

Office Action dated Jul. 25, 2026 issued in corresponding Chinese Patent Application No. 202180081685.5 (with English translation).

* cited by examiner

HEATER ASSEMBLY FOR USE IN AN AEROSOL-GENERATING SYSTEM

The present disclosure relates to a heater assembly for use in an aerosol-generating system, an aerosol-generating system comprising the heater assembly, a cartridge for use in an aerosol-generating system comprising the heater assembly and a method of using an aerosol-generating system comprising the heater assembly.

In many known aerosol-generating systems, a liquid aerosol-forming substrate is heated and vaporised to form a vapour. The vapour cools and condenses to form an aerosol. In some aerosol-generating systems, such as electrically heated smoking systems, this aerosol is then inhaled by a user.

Typically, the liquid aerosol-forming substrate comprises several compounds which are vaporised when heated. These compounds may have different boiling points. For example, a liquid aerosol-forming substrate may comprise nicotine (with a boiling point of around 247 degrees Celsius at atmospheric pressure) and glycerol (with a boiling point of around 290 degrees Celsius at atmospheric pressure).

When a liquid aerosol-forming substrate with compounds having different boiling points is heated, compounds with lower boiling points may be vaporised before compounds with higher boiling points. Alternatively, or in addition, compounds with lower boiling points may be vaporised at a higher rate than compounds with higher boiling points.

This may be undesirable because interactions and combinations between different compounds may be limited. For example, a liquid aerosol-forming substrate may comprise a nicotine compound and an organic acid compound, these compounds having different boiling points. Both of these compounds may be vaporised. The nicotine in the liquid aerosol-forming substrate may form free base nicotine when it is vaporised. However, it may be desirable to generate an aerosol with nicotine salt rather than free base nicotine. In order to form this nicotine salt, the free base nicotine may be protonated by the vaporised organic acid. However, this protonation may be limited if the organic acid has not yet been vaporised until after nicotine has been vaporised, or is vaporised more slowly than is required to protonate a suitable proportion of the free base nicotine.

Further, vaporising some compounds of an aerosol-forming substrate more quickly than others may undesirably cause the properties of the aerosol generated to change over time, for example over the course of a puff on an aerosol-generating system. This may be because, towards the beginning of a puff, when a heating element is activated and rises in temperature, liquid aerosol-forming substrate close to the heating element may reach a first temperature at which a first compound with a lower boiling point is vaporised but a second compound with a higher boiling point is not vaporised. Then, later in the puff, liquid aerosol-forming substrate close to the heating element may reach a second temperature at which the second compound with the higher boiling point is vaporised. However, by this time, much of the first compound in the liquid aerosol-forming substrate close to the heating element may have already been vaporised. Thus, towards the start of a puff, the aerosol generated may comprise a larger proportion of the first compound and, later in the puff, the aerosol generated may comprise a larger proportion of the second compound.

Alternatively, or in addition, the properties of the aerosol generated may change over the course of several puffs. This may occur where compounds of the liquid aerosol-forming substrate are not vaporised at an appropriate rate. For example, a liquid aerosol-forming substrate may comprise X percent by mass of a first compound and Y percent by mass of a second compound. If the liquid aerosol-forming substrate is not vaporised to produce a vapour comprising a mass ratio of the first compound to the second compound of X to Y, then the composition of the liquid aerosol-forming substrate may change as vapour is generated. This may, in turn, lead to a change in the properties of the aerosol generated by the liquid aerosol-forming substrate.

It is an aim of the invention to control the vaporisation of various compounds of a liquid aerosol-forming substrate, where these compounds have different boiling points.

According to the present disclosure there is provided, a heater assembly for use in an aerosol-generating system. The heater assembly may comprise a retention material. The retention material may contain an aerosol-forming substrate. The retention material may contain an aerosol-forming substrate in condensed form. The aerosol-forming substrate may comprise a first compound and a second compound. The second compound may have a higher boiling point than the first compound. The heater assembly may comprise at least one airflow path defined through the retention material. The heater assembly may comprise at least one heating element. The at least one heating element may be shaped to define an interior volume. The interior volume may be filled with the retention material. The interior volume may have a cross-sectional area that decreases along a longitudinal axis. The at least one airflow path may pass through a first central region of the interior volume. The at least one airflow path may pass through a second central region of the interior volume. The first and second central regions may be spaced-apart along the longitudinal axis.

When used in an aerosol-generating system, the heater assembly may be configured to generate a vapour or aerosol by heating the aerosol-forming substrate. In particular, the heater assembly may be connectable to a power supply of the aerosol-generating system such that power may be supplied to the heating element. In some embodiments, heat may be generated by the heating element restively or inductively. The heat may be transferred to the retention material filling the interior volume by conduction. Alternatively or additionally, the heating element may generate an alternating magnetic field and the retention material may comprise or consist of a susceptor element and the susceptor of the retention material may be inductively heated by the heating element. The heating element may then be a coil. The heating element may be an inductor coil. In any case, the retention material may be heated. Therefore, the aerosol-forming substrate contained by the retention material may also be heated. This may vaporise the aerosol-forming substrate contained by the retention material. Vapour generated at both the first and second central regions of the retention material may enter the at least one airflow path. This vapour may cool to form an aerosol which may be inhaled by a user through a mouthpiece of the aerosol-generating system.

The heater assembly, and particularly the geometry of the interior volume defined by the heating element of the heater assembly, may provide areas of higher temperature and areas of lower temperature in the retention material. The first central region of the interior volume of retention material may be heated to a different temperature than the second central region. For example, the first central region may be heated to a lower temperature than the second central region.

Alternatively, or in addition, the heater assembly may provide areas which increase in temperature at a greater rate, and areas which increase in temperature at a lesser rate, in the liquid aerosol-forming substrate storage component.

Advantageously, the heater assembly may improve control of the vaporisation of the different compounds of the liquid aerosol-forming substrate. The heater assembly may result in the first and second compound of the aerosol-forming substrate being vaporised simultaneously at desirable rates. The first compound may be predominantly vaporised at one of the first or second central regions. The second compound may be predominantly vaporised at the other of the first or second central regions. The heater assembly may result in the first and second compounds of the liquid aerosol-forming substrate being vaporised in more preferable proportions. The heater assembly may provide generation of an aerosol with a more desirable composition. The heater assembly may provide more consistent generation of an aerosol with desirable properties.

The difference in temperature of the first and second central regions of the interior volume may arise because of the of the decreasing cross-sectional area of the interior volume defined by the heating element. As the first and second central regions are spaced-apart along the longitudinal axis, the cross-sectional area of the volume of retention material at the first central region may be different to the cross-sectional area of the volume of retention material at the second central region. Therefore, where the cross-sectional area of the interior volume of retention material is smaller, the heating element may be closer to a central region of the retention material. For example, if the cross-sectional area of the volume of the retention material at the first central region is smaller than the cross-section area of the volume at the second central region, the heating element may be closer to the first central region than the second central region.

Heat may be transferred from the heating element to the retention element by conduction. The temperature of the first and second central regions may depend on the shortest distance between the heating element and the respective central region of the retention material. The temperature of the respective central region of the retention material may increase as the shortest distance to the heating element decreases along the longitudinal axis. The temperature difference may be particularly pronounced when the heater assembly is not in thermal equilibrium, for example, following initial activation of the heating element at the beginning of a puff. This is because there may be a lag or delay between initial activation of the heating element to heat the retention material and the central regions of the retention element reaching maximum temperature. The extent of the lag or delay may depend on the thermal conductivity of the retention material. The greater the distance between the heating element and the respective central region, the longer the lag or delay to reach a maximum temperature.

Alternatively, the heating element may be configured to generate an alternating magnetic field and the retention material may comprise or consist of a susceptor. The temperature of the first and second central region may depend on the density or strength of the alternating magnetic field. The magnetic flux density or the magnetic field strength of the alternating magnetic field may increase as the cross-sectional area of the interior volume decreases. The magnetic flux density or the magnetic field strength of the alternating magnetic field may increase the closer the heating element is to the respective central region of the retention material.

The vaporised compounds of the aerosol-forming substrate may enter the at least one airflow path passing the first and second central region. This may advantageously ensure that the vaporised compounds pass directly into the airflow path rather than passing through other regions of the retention element that may be at different temperatures. The vaporised compounds in the at least one airflow path may mix or otherwise combine and form an aerosol.

The heating element may be in contact with retention material. The retention material may have a fibrous or spongy structure. The retention material may comprise a capillary material. The retention material may comprise a bundle of capillaries. For example, the retention material may comprise one or more of fibres, threads, and fine bore tubes.

The retention material may comprise sponge-like or foam-like material. The structure of the retention material may form a plurality of small bores or tubes, through which the liquid can be transported by capillary action.

The retention material may comprise any suitable material or combination of materials. Suitable materials include but are not limited to: a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. Preferably, the retention material may comprise a ceramic. The retention material may have any suitable capillarity and porosity so as to be used with different liquid aerosol-forming substrates having different physical properties.

The heating element may have a spiral shape. The longitudinal axis may be defined along a central axis of the spiral shape. The cross-sectional area of the interior volume defined by the spiral shaped heating element may decrease from a first end of the interior volume to a second end of the interior volume. The first central region of the retention material may be located towards the first end of the interior volume. The second central region of the retention material may be located towards the second end of the interior volume. Therefore, in operation, the temperature of the first central region may be lower than the temperature of the second central region. This may have the advantages described above.

In a preferred embodiment, the spiral shape of the heating element is a truncated spiral. A radius of curvature of the heating element may decrease along the longitudinal axis in the same direction that the cross-sectional area of the interior volume decreases.

The heater assembly may comprise a first heating element and a second heating element. The interior volume of the retention material may be defined between the first heating element and the second heating element.

A separation between the first heating element and the second heating element may decrease along the longitudinal axis in the same direction that the cross-sectional area of the interior volume decreases. Each of the first and second heating elements may comprise a series of connected surfaces. The surfaces may in turn be substantially parallel to the longitudinal axis and substantially perpendicular to the longitudinal axis. The first and second heating elements may be arranged such that the separation between the substantially parallel surfaces of the first and second heating elements decreases along the longitudinal axis. Adjacent surfaces may form the steps. In other words, a step may be formed by a surface that is substantially parallel to the longitudinal axis and a surface that is substantially perpendicular to the longitudinal axis. The first and second heating elements may each comprise a first step and a second step.

The separation between the heating elements at the first step may be greater than at the second step. The first central portion of the retention material may be located between the first step of the first and second heating elements. The second central portion of the retention material may be located between the second step of the first and second heating elements. The first and second heating elements may comprise further steps, for example, the first and second heating elements may comprise a third step.

A minimum distance from the first central region to the heating element may be greater than a minimum distance from the second central region to the heating element.

The boiling point of the first compound may be between 160 and 280 degrees. The boiling point of the first compound may be about 247 degrees Celsius. The first compound may be nicotine.

The boiling point of the second compound may be between 210 and 330 degrees. The boiling point of the second component may be about 290 degrees Celsius. The second compound may be glycerol.

The interior volume may comprise a third central region spaced apart from the first and second central regions along the longitudinal axis. The third central portion may be located on an opposite side of the first central region compared to the second central region. In operation, the third central region may reach a lower temperature than the temperature of the first central portion and second central portion. The minimum distance from the third central region to the heating element may be greater than a minimum distance from the first central region to the heating element and greater than a minimum distance from the second central region to the heating element. It has already been described how providing regions of the interior volume having different temperature may improve the control of the vaporisation of various compounds of a liquid aerosol-forming substrate, where these compounds have different boiling points. By providing a third central region having an even lower temperature that the first region, the control of the vaporisation may advantageously be further improved.

Furthermore, the aerosol-forming substrate may comprise a third compound. The boiling point of the third component may be lower than the boiling point of the first compound. The boiling point of the third compound may be lower than the boiling point of second component. The boiling point of the third compound may be between 100 and 240 degrees Celsius, preferably between 120 and 220 degrees Celsius. Preferably, the boiling point of the third component may be 188 degrees Celsius. The third compound may be propylene glycol. At the low temperature of the third central region, the third component may advantageously be vaporised predominantly. By providing such a third central region, simultaneous vaporisation of each of the first, second and third compounds may be ensured.

The at least one airflow path may pass through a third central region of the interior volume, spaced-apart from the first central region and the second central region along the longitudinal axis. When the aerosol-forming substrate comprises a third compound, this may ensure that the vapour of all three compounds enters the at least one airflow path to be inhaled by a user.

The heater assembly may use a resistive heating arrangement. The at least one heating element may be a resistive heating element. The heater assembly, and particularly the heating element, may be configured to be electrically connected or connectable to a supply of electrical current. The heating element may comprise or be formed from any material with suitable electrical and mechanical properties. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation. The wires may be coated with one or more electrical insulators. Preferred materials may be 304, 316, 304L, 316L stainless steel, and graphite.

Additionally, combinations of the above materials may be used. For example, materials with a high resistivity may be combined with materials with a low resistivity. This may be advantageous if one of the materials is more beneficial from other perspectives, for example price, machinability or other physical and chemical parameters.

The resistance of the at least one heating element may increase along the longitudinal axis in the same direction that the cross-sectional area of the interior volume decreases. In operation, this may advantageously provide a temperature gradient along the length of the heating element. The temperature of the heating element may increase along the longitudinal axis in the same direction that the cross-sectional area of the interior volume decreases. As explained above, the first and second central regions of the retention material are generally heated to different temperatures as a result of the geometry of the interior volume defined by the heating element. The temperature gradient along the heating element may increase the temperature difference between the first and second central regions of the retention material. Therefore, providing a heating element having such a temperature gradient may allow for increased control of the vaporisation of the first and second compounds.

The resistance of the heating element may increase as a result of the cross-sectional area of the heating element decreasing. Varying the cross-section, or cross-sectional area, of the heating element may result in different sections of the heating element reaching different temperatures. For example, in a resistive heating element, a section of the heating element having a smaller cross-sectional area may have a larger resistance, and may therefore be resistively heated to a higher temperature.

Alternatively, or in addition, this may provide areas which increase in temperature at a greater rate, and areas which increase in temperature at a lesser rate, in the liquid aerosol-forming substrate storage component. As explained above, this may lead to liquid aerosol-forming substrate compounds with higher boiling points and lower boiling points being vaporised simultaneously at desirable rates.

The heating element may extend between a first end and a second end. For example, the length of the heating element may extend between a first end and a second end. The heating element may have a first cross-sectional area at a first point between the first end and the second end. The heating element may have a second cross-sectional area at a second point between the first point and the second end. For example, the first cross-sectional area may be at least 10, 20, 30, 40, 50, 60, 70, or 80 percent less than, the second cross-sectional area.

A minimum cross-sectional area along a length of the heating element may be at least 10 percent less than a maximum cross-sectional area along the length of the heating element. A minimum cross-sectional area along a length of the heating element may be at least 20, 40, 60, or 80 percent less than a maximum cross-sectional area along a length of the heating element.

A width or a thickness or both the width and the thickness of the heating element may vary along a length of the heating element.

The heater assembly may use an inductive heating arrangement. The use of inductive heating rather than a resistive arrangement provides improved energy conversion because of power losses associated with a resistive heater, in particular losses due to contact resistance at connections between the resistive heater and a power delivery system, are not present in inductive heating systems. In order to function, a restive heater is either permanently or replaceably connected to a power source through leads provided within a device or heater assembly. Even with improved automated manufacturing techniques, resistive heater systems typically have a contact resistance at the leads which creates parasitic losses. Replaceable resistive heater devices may also suffer from a build-up of films or other materials that increase the contact resistance between contacts of a replaceable cartridge and the leads. In contrast, inductive heating systems do not require contact between the heating elements and the leads and therefore do not suffer from the contact resistance issue present in resistive heater devices.

The at least one heating element may be a susceptor. The heating element as a susceptor may be configured to be heatable by an alternating magnetic field. The alternating magnetic field may be generated by an aerosol-generating system. The alternating magnetic field may be generated by passing an alternating current through an inductor coil of the aerosol-generating system, the inductor coil surrounding the heater assembly in use. The alternating current may have any suitable frequency. The alternating current may be a high frequency alternating current. The alternating current may have a frequency between 100 kilohertz (kHz) and 30 megahertz (MHz).

Heat generated by the heating element may be transferred to the retention material. In such cases, the inductive heating arrangement may have the advantage that no electrical contacts need to be formed between the heating element of the heater assembly and another component, for example, to a power supply of the aerosol-generating system. Furthermore, the heater assembly may be manufactured more cheaply. For example, the heater assembly may be manufactured as part of a cartridge. Cartridges are typically disposable articles produced in much larger numbers than the devices with which they operate. Accordingly, reducing the cost of cartridges, even if it requires a more expensive device, can lead to significant cost savings for both manufacturers and consumers.

Alternatively, the retention material may comprise a susceptor element. The retention material may consist of a susceptor element. The at least one heating element may form or comprise an inductor coil configured to heat the susceptor element of the retention material. The at least one heating element may be electrically connected or connectable to a power supply. The power supply may be configured to generate an alternating current. The heating element may be configured to generate an alternating magnetic field. The temperature of the first and second central region may depend on the magnetic flux density or the magnetic field strength of the alternating magnetic field. The density or strength of the alternating magnetic field may increase as the cross-sectional area of the interior volume defined by the heating element comprising or forming an inductor coil decreases. The magnetic flux density or the magnetic field strength of the alternating magnetic field may increase the closer the heating element is to the respective central region of the retention material. Such an arrangement may have the advantage that a large temperature gradient is maintained in the interior volume even when the heater assembly has reached thermal equilibrium or maximum temperature.

The heater assembly may comprise a first heating element and a second heating element, wherein each of the first heating element and second heating elements comprise or form an inductor coil. For example, the first heating element and second heating element may be stepped, as described above. The interior volume of retention material may be defined between the first heating element and second heating element. The first heating element may be positioned opposite to the second heating element. Each of the first and second heating elements may comprise flat inductor coils. Providing two heating elements comprising inductor coils may advantageously increase the magnetic field strength or magnetic flux density. The inductor coils may be arranged to provide magnetic fields that add to one another within the interior volume. Similarly, the alternating current passed through the first and second heating elements may be configured to provide magnetic fields that add to one another within the interior volume. An alternating current of the same frequency may be passed through each of the first and second heating elements. The alternating current may be supplied by the same power supply.

The at least one airflow path may comprise an airflow path defined through the retention material and passing through the first central region and second central region in a direction parallel to the longitudinal axis. The airflow path may be arranged such that, in use, air enters the retention material from the end having the largest cross-sectional area. In other words, the air may pass the cooler of the first or second central regions first. Incoming air may be considerably cooler than the retention material when the heater assembly is in operation. Therefore, air entering the retention material may advantageously cool the respective central region. When the air reaches the other of the first or second central regions, it may have been heated by the heater assembly and so the cooling effect of the air may have lessened. Therefore, such an arrangement of the airflow path may advantageously increase the difference in temperature between the first central region and the second central region.

Alternatively, the at least one airflow path may comprise a first airflow path defined through the retention material that passes through the first central region in a direction perpendicular to the longitudinal axis. The at least one airflow path may comprise a second airflow path defined through the retention material that passes through the second central region in a direction perpendicular to the longitudinal axis.

The heater assembly may comprise a reservoir for storing aerosol-forming substrate. The heater assembly may comprise a reservoir of aerosol-forming substrate. The reservoir may be configured to supply the aerosol-forming substrate to the retention material. The reservoir may be configured to supply the aerosol-forming substrate to the retention material where the interior volume filled by the retention material has the largest cross-sectional area. In use, this may advantageously increase the temperature difference between the first and second central region of the interior volume because the aerosol-forming substrate in the reservoir may be cooler than the aerosol-forming substrate in the retention material.

The retention material may store, or be configured to store, aerosol-forming substrate. The retention material may be in fluid communication with the reservoir.

The reservoir may comprise a reservoir housing containing the aerosol-forming substrate. A channel may be defined through the housing. The at least one airflow channel may pass through this channel.

According to the present disclosure there is also provided an aerosol-generating system comprising the heater assembly as described above. The aerosol-generating system may further comprise a power supply connectable to the heater assembly. The aerosol-generating system may further comprise a controller to control the power supplied to the heater assembly from the power supply. Thus, the controller may control heating of the heating element.

The power supply may be a battery. The power supply may be configured to supply power to the heating element. This may be to heat the heating element.

The power supply may be configured to supply power to the heating element to resistively heat the heating element. The aerosol-generating system may comprise an inductor coil.

The power supply of the aerosol-generating system may be configured to provide an alternating current to the inductor coil when the at least one heating element of the heater assembly forms or comprises an inductor coil. The power supply of the aerosol-generating system may be configured to provide an oscillating current to the inductor coil when the at least one heating element of the heater assembly forms or comprises an inductor coil. The oscillating current may be a high frequency oscillating current. As used herein, a high frequency oscillating current means an oscillating current having a frequency of between 100 kHz and 10 MHz.

The aerosol-generating system may comprise a cartridge, the cartridge comprising a cartridge housing containing the heater assembly. The cartridge may be configured to engage with the aerosol-generating device. The power supply may be configured to supply power to the heating element only when the cartridge is engaged with the aerosol-generating device.

The cartridge may comprise an air inlet. The cartridge may comprise an air outlet. The air inlet may be in fluid communication with the air outlet. The heating element may be disposed downstream of the air inlet. The heating element may be disposed upstream of the air outlet.

The cartridge may comprise first and second electrical contacts electrically connected to the heating element. The electrical contacts may comprise one or more of tin, silver, gold, copper, aluminium, steel such as stainless steel, phosphor bronze, tin alloyed with antimony, tin alloyed with zirconium, tin alloyed with bismuth, or tin alloyed with other components improving resistance to organic acids.

The electrical contacts may be configured to form an electrical connection with corresponding electrical contacts on an aerosol-generating device when the cartridge is engaged with the aerosol-generating device.

The reservoir optionally described in relation to the heater assembly may instead form part of the cartridge. The heater assembly and, particularly, the retention material of the heater assembly, may be in fluid communication with the reservoir.

The aerosol-generating system may further comprise an aerosol-generating device. The cartridge may be removably receivable in the aerosol-generating device.

The aerosol-generating device may comprise a device housing containing the power supply and the controller.

The aerosol-generating system may further comprise a mouthpiece in fluid communication with at least one airflow path, allowing a user to draw air through the at least one airflow path. The cartridge may comprise the mouthpiece. In use, when the cartridge is engaged with an aerosol-generating device, a user may puff on the mouthpiece of the cartridge. This may cause air to flow in through the air inlet, then across, over, past, or through the heater assembly or heating element, then through the air outlet.

The aerosol-generating system may be a handheld aerosol-generating system. The aerosol-generating system may be an electrically heated smoking system.

According to the present disclosure there is also provided a cartridge for use in the aerosol-generating system described above, the cartridge comprising a heater assembly as described above.

According to the disclosure there is also provided a method of using an aerosol-generating system, the aerosol-generating system comprising a retention material containing an aerosol-forming substrate in condensed form, the aerosol-forming substrate comprising a first compound and a second compound, the second compound having a higher boiling point than the first compound; at least one airflow path defined through the retention material; a heater assembly comprising at least one heating element shaped to define an interior volume, the interior volume filled with the retention material; a power supply; and a controller to control the power supplied to the heater assembly from the power supply; wherein the interior volume has a cross-sectional area that decreases along a longitudinal axis; and wherein the at least one airflow path passes through a first central region of the interior volume and a second central region of the interior volume, the first and second central regions being spaced-apart along the longitudinal axis; the method comprising activating the at least one heating element to heat the retention material such that the first central region is heated to a different temperature to the second central region.

The step of activating the at least one heating element may comprise heating the first central region to a temperature that is lower than the temperature of the second central region.

The step of activating the at least one heating element may comprise heating the first central region to a temperature that is at least 20 degrees Celsius lower than the temperature of the second central region.

The step of activating the at least one heating element may comprise heating the first central region of the of the interior volume to a temperature of between 160 and 280 degrees Celsius.

The step of activating the at least one heating element may comprise heating the second central region of the of the interior volume to a temperature of between 210 and 330 degrees Celsius.

The step of activating the at least one heating element may comprise heating aerosol-forming substrate such that a vapour is generated which enters into the at least one airflow path.

The vapour entering into the portion of the at least one airflow path passing through the first central region of the interior volume comprises the first compound in a higher amount by weight than the second compound.

The vapour entering a portion of the at least one airflow path passing through the second central region of the interior volume comprises the second compound in a higher amount by weight than the first compound.

As used herein, the term "aerosol" refers to a dispersion of solid particles, or liquid droplets, or a combination of solid particles and liquid droplets, in a gas. The aerosol may be visible or invisible. The aerosol may include vapours of substances that are ordinarily liquid or solid at room temperature as well as solid particles, or liquid droplets, or a combination of solid particles and liquid droplets.

As used herein, the term "aerosol-forming substrate" refers to a substrate capable of releasing volatile compounds that can form an aerosol. The volatile compounds may be released by heating or combusting the aerosol-forming substrate.

The aerosol-forming substrate may comprise a plurality of compounds. The plurality of compounds may have different boiling points. For example, the aerosol-forming substrate may comprise a first compound with a first boiling point at atmospheric pressure and a second compound with a second boiling point at atmospheric pressure, the first boiling point being greater than the second boiling point. The aerosol-forming substrate may comprise a third compound with a third boiling point at atmospheric pressure.

The aerosol-forming substrate may comprise an aerosol former. As used herein, the term "aerosol-former" refers to any suitable compound or mixture of compounds that, in use, facilitates formation of an aerosol, for example a stable aerosol that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

The aerosol-forming substrate may comprise nicotine. The aerosol-forming substrate may comprise water. The aerosol-forming substrate may comprise glycerol, also referred to as glycerine, which has a higher boiling point than nicotine. The aerosol-forming substrate may comprise propylene glycol. The aerosol-forming substrate may comprise plant-based material. The aerosol-forming substrate may comprise homogenised plant-based material. The aerosol-forming substrate may comprise tobacco. The aerosol-forming substrate may comprise a tobacco-containing material. The tobacco-containing material may contain volatile tobacco flavour compounds. These compounds may be released from the aerosol-forming substrate upon heating. The aerosol-forming substrate may comprise homogenised tobacco material. The aerosol-forming substrate may comprise other additives and ingredients, such as flavourants.

As used herein, the term "liquid aerosol-forming substrate" is used to refer to an aerosol-forming substrate in condensed form. Thus, the "liquid aerosol-forming substrate" may be, or may comprise, one or more of a liquid, gel, or paste. If the liquid aerosol-forming substrate is, or comprises, a gel or paste, the gel or paste may liquidise upon heating. For example, the gel or paste may liquidise upon heating to a temperature of less than 50, 75, 100, 150, or 200 degrees Celsius.

As used herein, the term "heating element" encompasses both an element that is configured to itself raise in temperature when supplied with power and an element that is configured to give rise to an increase in temperature of a coupled component when supplied with power, such as an inductor coil coupled to a susceptor element.

As used herein, a "susceptor element" means a conductive element that heats up when subjected to a changing magnetic field. This may be the result of eddy currents induced in the susceptor element and/or hysteresis losses. Possible materials for the susceptor elements include graphite, molybdenum, silicon carbide, stainless steels, niobium, aluminium and virtually any other conductive elements. Advantageously the susceptor element is a ferrite element. The material and the geometry for the susceptor element can be chosen to provide a desired electrical resistance and heat generation.

Below, there is provided a non-exhaustive list of non-limiting examples. Any one or more of the features of these examples may be combined with any one or more features of another example, embodiment, or aspect described herein.

EX1. A heater assembly for use in an aerosol-generating system, the heater assembly comprising:

a retention material containing an aerosol-forming substrate in condensed form, the aerosol-forming substrate comprising a first compound and a second compound, the second compound having a higher boiling point than the first compound;

at least one airflow path defined through the retention material; and at least one heating element shaped to define an interior volume, the interior volume filled with the retention material;

wherein the interior volume has a cross-sectional area that decreases along a longitudinal axis; and wherein the at least one airflow path passes through a first central region of the interior volume and a second central region of the interior volume, the first and second central regions being spaced-apart along the longitudinal axis.

EX2. A heater assembly according to example EX1, comprising a heating element having a spiral shape.

EX3. A heater assembly according to example EX2, wherein the spiral shape of the heating element is a truncated spiral.

EX4. A heater assembly according to examples EX2 or EX3, wherein a radius of curvature of the heating element decreases along the longitudinal axis in the same direction that the cross-sectional area of the interior volume decreases.

EX5. A heater assembly according to example EX1, comprising a first heating element and a second heating element.

EX6. A heater assembly according to example EX5, wherein the interior volume of the retention material is defined between the first heating element and the second heating element.

EX7. A heater assembly according to example EX5 or EX6, wherein a separation between the first heating element and the second heating element decreases along the longitudinal axis in the same direction that the cross-sectional area of the interior volume decreases.

EX8. A heater assembly according to any one of the preceding examples, wherein a minimum distance from the first central region to the heating element is greater than a minimum distance from the second central region to the heating element.

EX9. A heater assembly according to any one of the preceding examples, wherein the boiling point of the first compound is between 160 and 280 degrees.

EX10. A heater assembly according to any of the preceding examples, wherein the boiling point of the second compound is between 210 and 330 degrees.

EX11. A heater assembly according to any one of the preceding claims, wherein the aerosol-forming substrate comprises a third compound.

EX12. A heater assembly according to example EX11, wherein a boiling point of the third compound is between 120 and 220 degrees.

EX13. A heater assembly according to examples EX11 or EX12, wherein the at least one airflow path passes through a third central region of the interior volume, spaced-apart from the first central region and the second central region along the longitudinal axis.

EX14. A heater assembly according to example EX13, wherein the third central region is located on an opposite side of the first central region compared to the second central region.

EX15. A heater assembly according to examples EX13 or EX14, wherein a minimum distance from the third central region to the heating element is greater than a minimum distance from the first central region to the heating element and greater than a minimum distance from the second central region to the heating element.

EX16. A heater assembly according to any one of the preceding examples, wherein the at least one heating element is a resistive heating element.

EX17. A heater assembly according to any one of the preceding examples, wherein the resistance of the at least one heating element increases along the longitudinal axis in the same direction that the cross-sectional area of the interior volume decreases.

EX18. A heater assembly according to example EX17, wherein the resistance of the heating element increases as a result of the cross-sectional area of the heating element decreasing.

EX19. A heater assembly according to any one of examples EX1 to EX17, wherein the at least one heating element is a susceptor.

EX20. A heater assembly according to any one of examples EX1 to EX17, wherein the retention material comprises a susceptor element and the at least one heating element forms or comprises an inductor coil configured to heat the susceptor element of the retention material.

EX21. A heater assembly according to example EX20, comprising a first heating element and a second heating element, wherein each of the first heating element and second heating elements comprise or form an inductor coil.

EX22. A heater assembly according to any one of the preceding examples, wherein the at least one airflow path comprises an airflow path defined through the retention material and passing through the first central region and second central region in a direction parallel to the longitudinal axis.

EX23. A heater assembly according to any one examples EX1 to EX21, wherein the at least one airflow path comprises a first airflow path defined through the retention material that passes through the first central region in a direction perpendicular to the longitudinal axis.

EX24. A heater assembly according to example EX23, wherein the at least one airflow path comprises a second airflow path defined through the retention material that passes through the second central region in a direction perpendicular to the longitudinal axis.

EX25. A heater assembly according to any of the preceding examples, wherein the retention material is formed of a ceramic.

EX26. An aerosol-generating system comprising the heater assembly according to any one of the preceding examples.

EX27. An aerosol-generating system according to example EX26, further comprising a power supply connectable to the heater assembly; and a controller to control the power supplied to the heater assembly from the power supply.

EX28. An aerosol-generating system according to example EX27, wherein the power supply of the aerosol-generating system is configured to provide a high frequency oscillating current to the inductor coil when the at least one heating element of the heater assembly forms or comprises an inductor coil.

EX29. An aerosol-generating system according to any one of examples EX26 to EX28, wherein the aerosol-generating system comprises a cartridge, the cartridge comprising a cartridge housing containing the heater assembly.

EX30. An aerosol-generating system according to example EX29, wherein the aerosol-generating system further comprises an aerosol-generating device and wherein the cartridge is removably receivable in the aerosol-generating device.

EX31. An aerosol-generating system according to example EX30, wherein the aerosol-generating device comprises a device housing containing the power supply and the controller.

EX32. An aerosol-generating system according to any one of examples EX26 to EX31, further comprising a mouthpiece in fluid communication with at least one airflow path, allowing a user to draw air through the at least one airflow path.

EX33. An aerosol-generating system according to any one of examples EX26 to EX32, wherein the aerosol-generating system is a handheld aerosol-generating system.

EX34. An aerosol-generating system according to any one of examples EX26 to EX33, wherein the aerosol-generating system is an electrically heated smoking system.

EX35. A cartridge for use in an aerosol-generating system, the cartridge comprising a heater assembly as defined in any one of examples EX1 to EX25.

EX36. A method of using an aerosol-generating system, the aerosol-generating system comprising a retention material containing an aerosol-forming substrate in condensed form, the aerosol-forming substrate comprising a first compound and a second compound, the second compound having a higher boiling point than the first compound;

at least one airflow path defined through the retention material;

a heater assembly comprising at least one heating element shaped to define an interior volume, the interior volume filled with the retention material;

a power supply; and a controller to control the power supplied to the heater assembly from the power supply;

wherein the interior volume has a cross-sectional area that decreases along a longitudinal axis; and wherein the at least one airflow path passes through a first central region of the interior volume and a second central region of the interior volume, the first and second central regions being spaced-apart along the longitudinal axis;

the method comprising activating the at least one heating element to heat the retention material such that the first central region is heated to a different temperature to the second central region.

EX37. A method of using an aerosol-generating system according to example EX36, wherein the step of activating the at least one heating element comprises heating the first central region to a temperature that is lower than the temperature of the second central region.

EX38. A method of using an aerosol-generating system according to example EX36 or EX37, wherein the step of activating the at least one heating element comprises heating the first central region to a temperature that is at least 20 degrees Celsius lower than the temperature of the second central region.

EX39. A method of using an aerosol-generating system according to example EX38, wherein the step of activating the at least one heating element comprises heating the first central region of the of the interior volume to a temperature of between 160 and 280 degrees Celsius.

EX40. A method of using an aerosol-generating system according to any one of examples EX36 to EX39, wherein the step of activating the at least one heating element comprises heating the second central region of the of the interior volume to a temperature of between 2410 and 330 degrees Celsius.

EX41. A method of using an aerosol-generating system according to any one of examples EX36 to EX40, wherein the step of activating the at least one heating element comprises heating aerosol-forming substrate such that a vapour is generated which enters into the at least one airflow path.

EX42. A method of using an aerosol-generating system according to example EX41, wherein the vapour entering into a portion of the at least one airflow path passing through the first central region of the interior volume comprises the first compound in a higher amount by weight than the second compound.

EX43. A method of using an aerosol-generating system according to examples EX41 or EX42, wherein the vapour entering a portion of the at least one airflow path passing through the second central region of the interior volume comprises the second compound in a higher amount by weight than the first compound.

Features described in relation to one example or embodiment may also be applicable to other examples and embodiments.

Examples will now be further described with reference to the figures in which.

Figure 1:
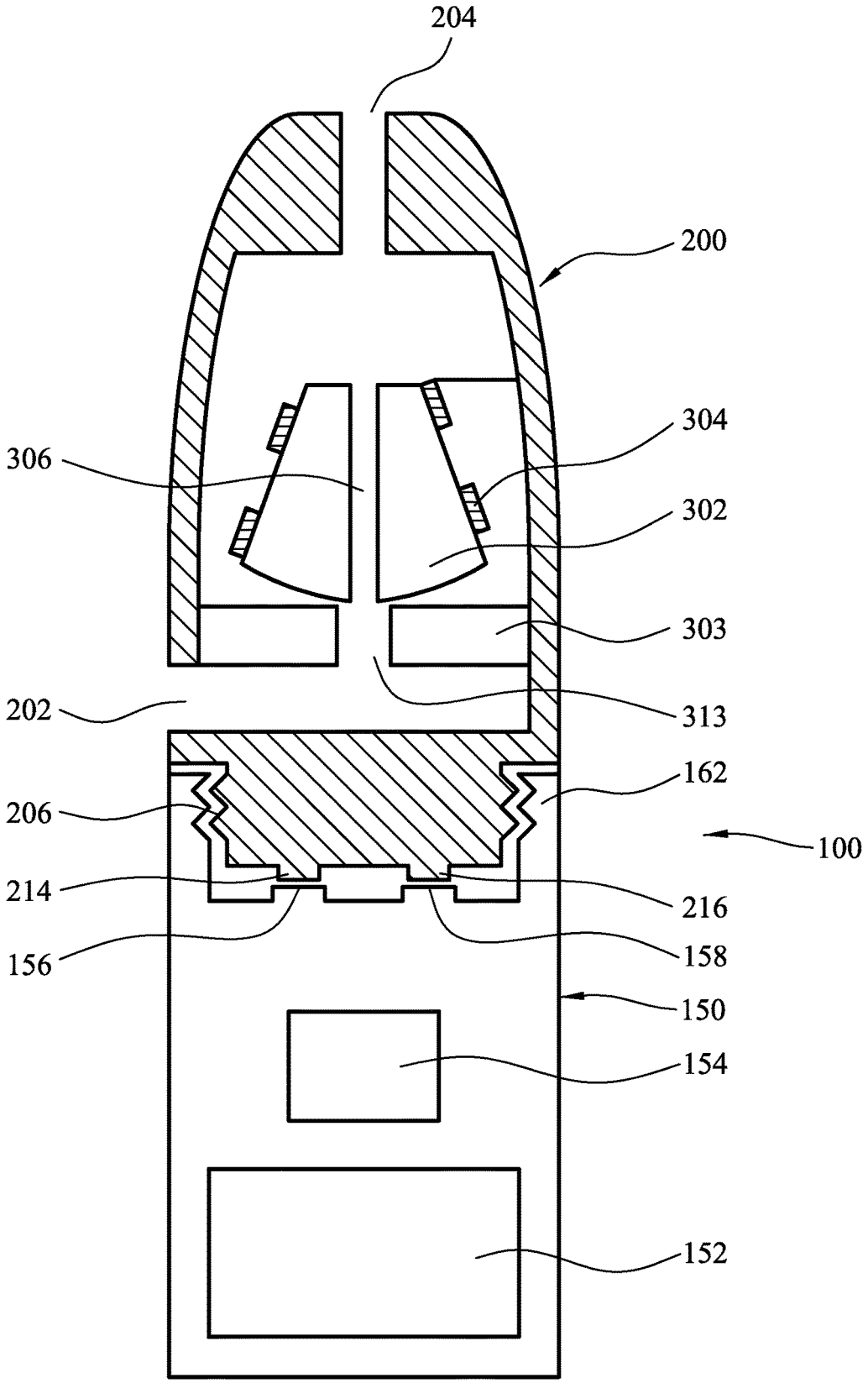
FIG. 1 shows a cross-sectional schematic view of a first aerosol-generating system comprising a cartridge incorporating a first heater assembly.

FIG. 1 shows a cross-sectional view of a first aerosol-generating system 100. The aerosol-generating system 100 comprises an aerosol-generating device 150 and a cartridge 200. In this example, the aerosol-generating system 100 is an electrically operated smoking system.

The aerosol-generating device 150 is portable and has a size comparable to a conventional cigar or cigarette. The device 150 comprises a battery 152, such as a lithium iron phosphate battery, and a controller 154 electrically connected to the battery 152. The device 150 also comprises two electrical contacts 156, 158 which are electrically connected to the battery 152. This electrical connection is a wired connection and is not shown in FIG. 1. In FIG. 1, the aerosol-generating device 150 is engaged with the cartridge 200. In this example, the cartridge 200 is engaged with the aerosol-generating device 150 via a screw thread 206 of the cartridge 200 mated with a corresponding screw thread 162 of the aerosol-generating device 150.

The cartridge 200 comprises first and second electrical contacts 214, 216, an air inlet 202, an air outlet 204, and a first heater assembly 300. The air inlet 202 is in fluid communication with the air outlet 204. The heater assembly 300 is positioned downstream of the air inlet 202 and upstream of the air outlet 204. The heater assembly 300 comprises a retention material 302 in fluid communication with a reservoir 303 of liquid aerosol-forming substrate. The reservoir 303 is described herein as a separate component to the heater assembly 300. However, in some embodiments, the reservoir 300 forms part of the heater assembly. The heater assembly 300 also comprises a spiral shaped heating element 304. The first and second electrical contacts 214, 216 are electrically connected to the heating element 304. An airflow path 306 is defined through the centre of the retention material 302.

In this system 100, the liquid aerosol-forming substrate comprises around 74% by weight glycerine, 24% by weight propylene glycol, and 2% by weight nicotine, though any suitable substrate could be used. At atmospheric pressure, nicotine has a boiling point of around 247 degrees centigrade, glycerine has a boiling point of around 290 degrees centigrade and propylene glycol has a boing point of around 188 degrees centigrade. Thus, when initially heating this liquid aerosol-forming substrate to form an aerosol, some systems may undesirably vaporise a disproportionately large amount of propylene glycol (which has the lowest boiling point of the compounds forming the substrate). This may lead to a less desirable aerosol being delivered to the user, such as an aerosol comprising a smaller proportion of nicotine than desired. This may also undesirably change the relative proportions of the compounds in the substrate over a longer time period. The present invention may eliminate or at least reduce these undesirable effects.

In use, a user puffs on the air outlet 204 of the cartridge 200. At the same time, the user presses a button (not shown) on the aerosol-generating device 150. Pressing this button sends a signal to the controller 154, which results in power being supplied from the battery 152 to the heating element 304 via the electrical contacts 156, 158 of the device and the electrical contacts 214, 216 of the cartridge. This causes a current to flow through the heating element 304, thereby resistively heating the heating element 304. In other examples, an air flow sensor, or pressure sensor, is located in the cartridge 200 and electrically connected to the controller 154. The air flow sensor, or pressure sensor, detects that a user is puffing on the air outlet 204 of the cartridge 200 and sends a signal to the controller 154 to provide power to the heating element 304. In these examples, there is therefore no need for the user to press a button to heat the heating element 304.

As the user puffs on the air outlet 204 of the cartridge 200, air is drawn into the air inlet 202. This air then travels through a channel 313 defined through the reservoir 303 and then through airflow path 306 defined through the retention material 306 and towards the air outlet 204. This flow of air entrains the vapour formed by the heating element 304 heating liquid aerosol-forming substrate in the liquid aerosol-forming substrate storage component 302. This entrained vapour then cools and condenses to form an aerosol. This aerosol is then delivered to the user via the air outlet 204. As liquid aerosol-forming substrate in the retention material 302 is heated, vaporised, and entrained in the air flow, liquid aerosol-forming substrate from the reservoir 303 travels into the retention material 302. This liquid aerosol-forming substrate from the reservoir 303 effectively replaces the vaporised liquid aerosol-forming substrate. The liquid aerosol-forming substrate from the reservoir 303 may be drawn into the retention material 302, at least partly, by capillary action. This is because the liquid aerosol-forming substrate storage component 302 is a capillary material having a fibrous structure. The retention material 302 in this example is a capillary material having a fibrous structure. In the example shown in FIG. 1, the capillary material is formed form polyester, though any suitable material could be used.

Figure 2:
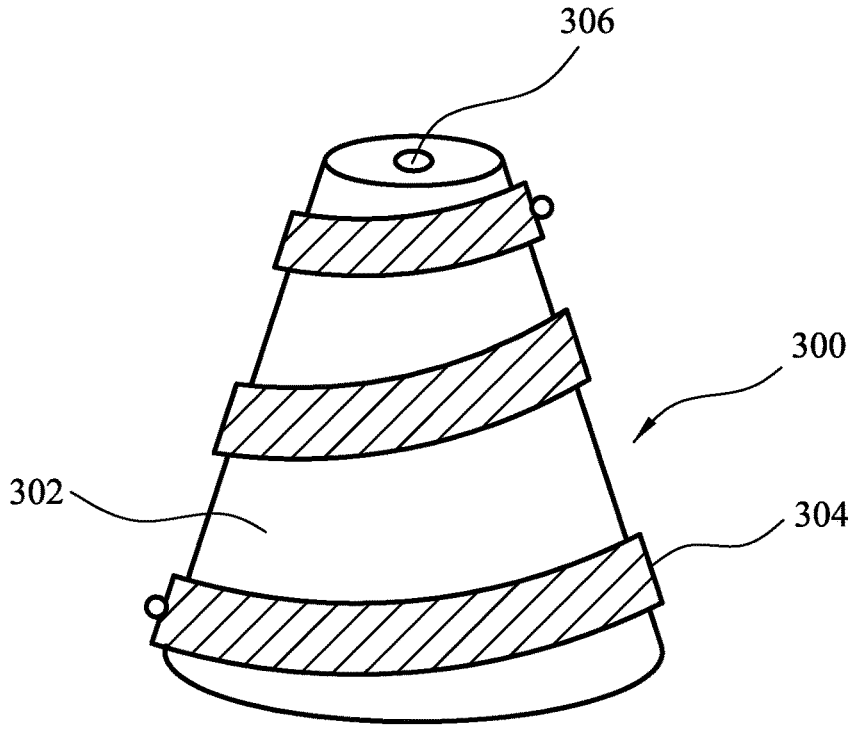
FIG. 2 shows a perspective view of the first heater assembly of FIG. 1.
Figure 3:
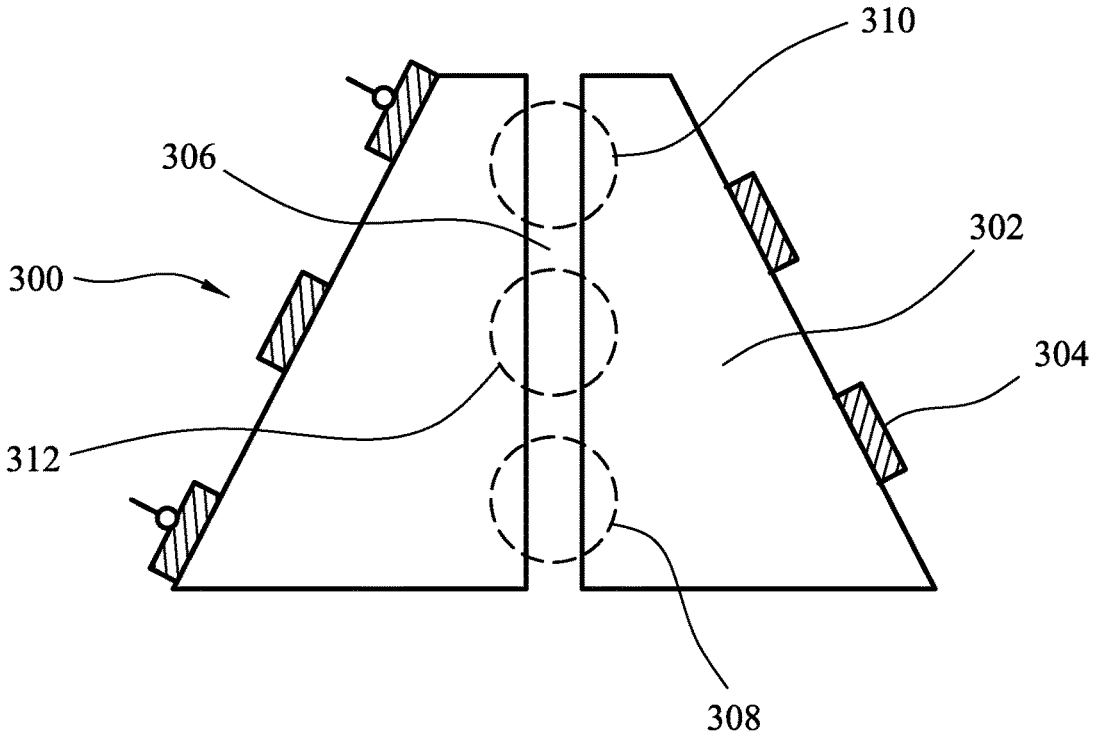
FIG. 3 shows a cross-sectional schematic view of the first heater assembly of FIG. 1 separately from the from the aerosol-generating system.

The heater assembly is shown more clearly in FIGS. 2 and 3 which illustrate the heater assembly 300 separately from the rest of the aerosol-generating system.

FIG. 2 shows a perspective view of the heater assembly 300 which shows how the heating element 304 is spiral shaped, having the form of a truncated spiral. The spiral shape of the heating element 304 defines an interior volume which is filled with retention material 302. The cross-sectional area of the interior volume decreases along a longitudinal axis defined through the centre of the spiral shape. The retention material 302 filling the interior volume has a truncated cone shape. The heating element 304 is a strip of material. In this example, the material is stainless steel, though any suitable material could be used.

The heating element 304 has a uniform cross-sectional area along its length and a uniform thickness and width along its length. The heating element 304 has a uniform resistance along its length. Therefore, in use and when power is supplied to the heating element 304, the heating power of the heating element 304 is substantially constant along the length of the heating element 304. However, because of the geometry of the interior volume defined by the heating element 304, the centre of the retention material comprises areas of higher temperature and areas of lower temperature. This is shown more clearly in FIG. 3.

FIG. 3 shows a cross-sectional view of the heater assembly 300. Three central regions of the interior volume filled with retention material 302 are indicated by dotted lines. The three central regions are spaced apart along a longitudinal axis. A first central region 312 is located between a second central region 310 and a third central region 308. The second central region 310 is located towards a first end of longitudinal axis, where the cross-sectional area of the interior volume is smallest. The third central region 308 is located towards a second end of the longitudinal axis where the cross-sectional area of the interior volume is largest. In use, air passing through the airflow path 306 passes sequentially through the third central region 308, the first central region 312 and the second central region 310.

As described above, the cross-sectional area of the interior volume of retention material 302 decreases along the longitudinal axis. Heat is transferred from the heating element to the retention element by conduction and so the temperature of the first and second central region depends on the shortest distance between the heating element and the respective central region of the retention material. Where the cross-sectional area of the volume of retention material is smaller, the heating element 304 is closer to the centre the retention material. As shown in FIG. 3, the second central region 310 closer to the heating element 304 than the first central region 312 which, in turn, is closer to the heating element 304 than the third central region 308. This results in non-uniform heating of the retention material filling the interior volume with the third central region 308 being heated to a lower temperature than the first central region 312 which, in turn, is heated to a lower temperature than the second central region 310.

The difference in temperature between the first, second and third central regions 312, 310 and 308 results in the vapour generated at first central region 312 comprising a different proportion of nicotine by weight compared to the vapour generated at the second and third central regions 310,308. Similarly, the vapour generated at the first central region comprises glycerol and propylene glycol in different proportion by weight compared to the second central region and third central region. In particular, propylene glycol, which has the lowest boiling point, is vaporised at the coolest third central region, nicotine which has a higher boiling point than propylene glycol is predominantly vaporised at the intermediate first central region 312 and glycerol, which has the highest boiling point, is predominantly vaporised at the hottest second central region 310.

The temperature difference between the central regions of the retention material 302 are particularly pronounced when the heater assembly is not in thermal equilibrium, for example, following initial activation of the heating element. This is because there is a lag or delay between the initial activation of the heating element to heat the retention material and the central regions of the retention element reaching a maximum temperature. The extent of the lag or delay depends on the thermal conductivity of the retention material. The greater the distance between the heating element and the respective central region, the longer the lag or delay to reach a maximum temperature.

The airflow path 306 passes through the first, second and third central regions 312,310,308 in a direction parallel to the longitudinal axis. The airflow path 306 is arranged such that, in use, air enters the airflow path from the end of the retention material 302 having the largest cross-sectional area. In other words, passing through third central region 308 first. In operation, the third central region 308 is the coolest. Incoming air is considerably cooler than the retention material 302 when the heater assembly is in operation. Therefore, air entering the airflow path may advantageously act to cool the third central region. When the air reaches the first and then second central regions 312,310, it will have been heated by the heater assembly and so the cooling effect of the air progressively lessons. Therefore, such an arrangement of the airflow path 306 increases the difference in temperature between the third central region, first central region and second central region.

Figure 4:
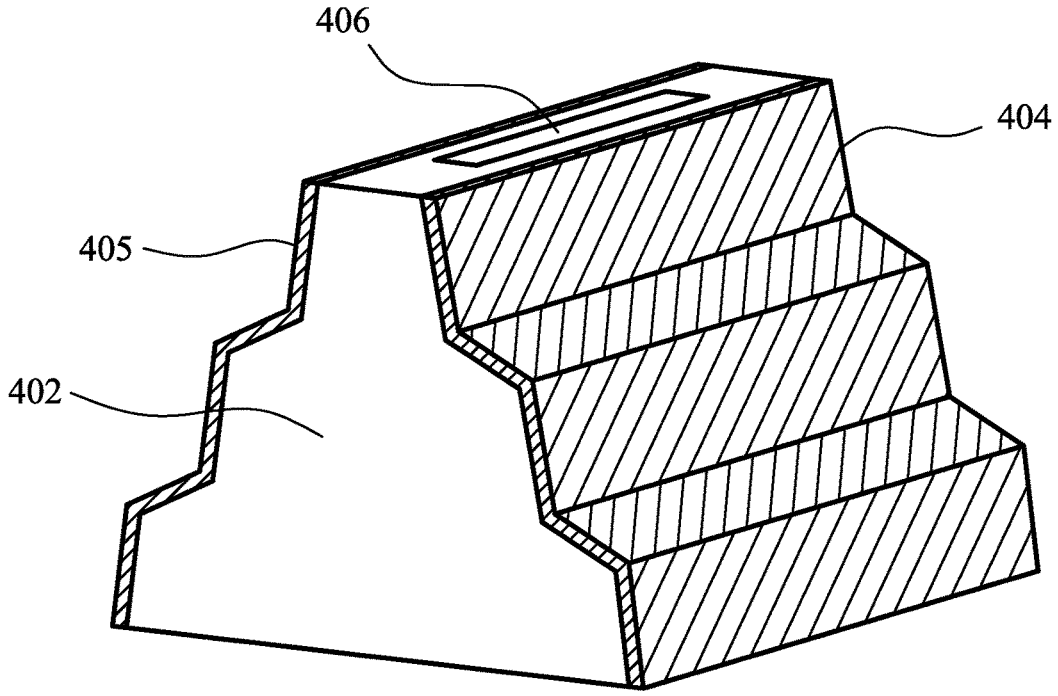
FIG. 4 shows a perspective view of a second heater assembly separately from the aerosol-generating system.
Figure 5:
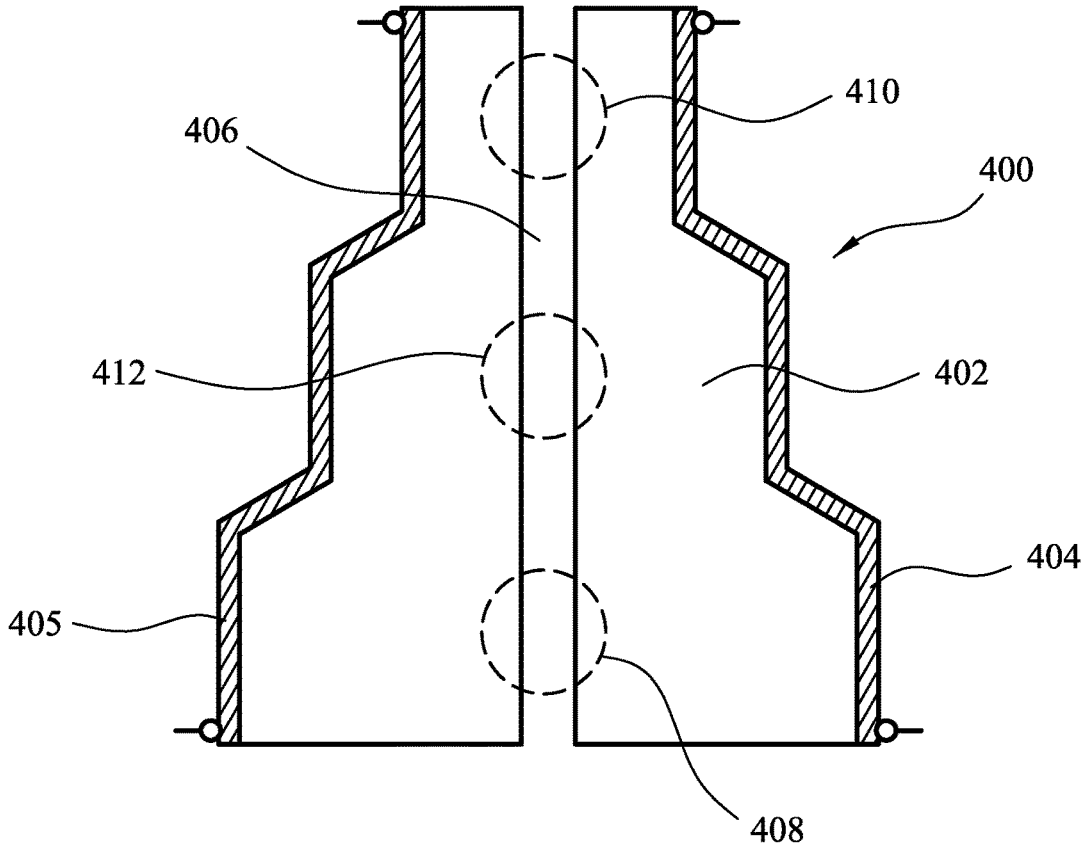
FIG. 5 shows a cross-sectional schematic view of the second heater assembly of FIG. 4.

FIGS. 4 and 5 show a second heater assembly 400 comprising a first heating element 404 and a second heating element 405. FIG. 4 shows a perspective view and FIG. 5 shows a cross-sectional view of the second heater assembly 400. Both the first heating element 404 and the second heating element 405 are stepped and comprise three steps configured such that the heating elements get progressively closer together. This is shown most clearly in FIG. 5. Between the first and second heating elements 404, 405 is defined an interior volume which is filled with retention material 402. The cross-sectional area of the interior volume decreases along a longitudinal axis as a result of the stepped heating elements. The longitudinal axis is defined through the centre of the interior volume. The first and second heating elements 404,405 are both shaped strips of material. In this example, the material is stainless steel, though any suitable material could be used.

FIG. 5 shows three central regions of the interior volume defined by the heating elements 404,405. The three central regions are indicated by dotted lines. The three central regions are spaced apart along the longitudinal axis. A first central region 412 is located between a second central region 410 and a third central region 408. The second central region 410 is located towards a first end of longitudinal axis, where the cross-sectional area of the interior volume is smallest. The third central region 408 is located towards a second end of the longitudinal axis where the cross-sectional area of the interior volume is largest. In use, air passing through the airflow path 406 passes sequentially through the third central region 408, the first central region 412 and the second central region 410. In use, air passing through the airflow path 306 passes sequentially through the third central region 408, the first central region 412 and the second central region 410.

Figure 6:
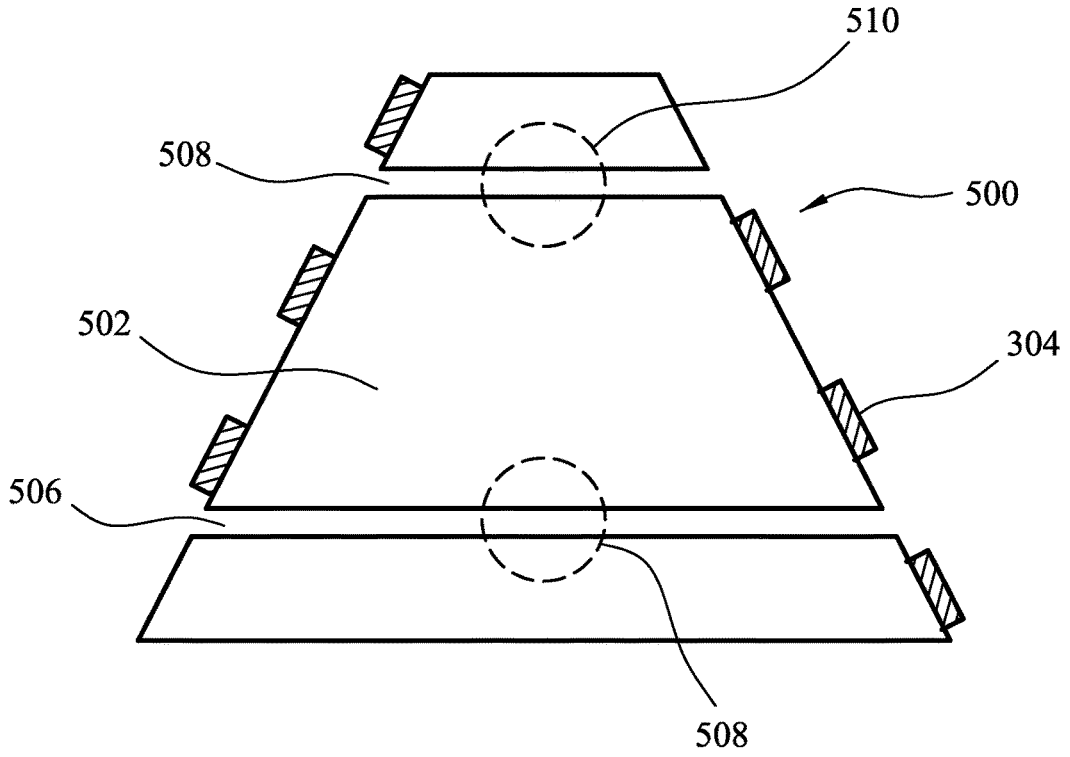
FIG. 6 shows a cross-sectional schematic view of a third heater assembly, similar to the first heater assembly of FIG. 1 but with a different airflow path arrangement.

Therefore, like the first heater assembly, the second heater assembly provides an arrangement where the first, second and third central portions are different directions FIG. 6 shows a third heater assembly 500. The third heater assembly 500 comprises two airflow paths 506, 507, rather a single airflow path as shown in the first and second heater assemblies. The interior volume defined by the heating element 304 is filled with retention material 502. A first airflow path 506 is defined through a first central region 508 of the interior volume. A second airflow path 507 is defined through a second central region 510 of the interior volume. Of course, the interior volume comprises other central regions between and either side of the first and central regions 508,510. However, FIG. 6 does not show an airflow path defined through these central regions. In some embodiments, the heater assembly 500 can comprise additional airflow paths passing through different central regions of the retention material.

In all other respects, the third heater assembly 500 is the same as first heater assembly 300.

Figure 7:
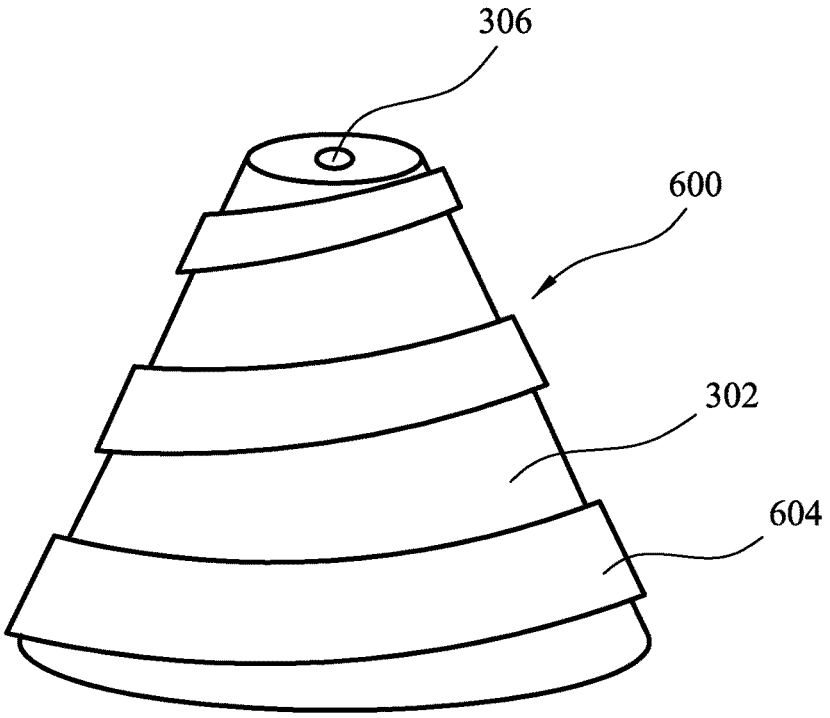
FIG. 7 shows a cross-sectional schematic view of a fourth heater assembly, similar to the first heater assembly of FIG. 1 but with a heating element having a cross-sectional area that decreases along the length of the heating element.

FIG. 7 shows a fourth heater assembly. The fourth heater assembly 600 comprises a spiral shaped heating element 604. The spiral shaped heating element differs from the heating element 304 of the first heater assembly in that the width of the heating element decreases along the longitudinal axis in the same direction that the cross-section area of the interior volume decreases. In all other respects, the fourth heater assembly 600 is the same as the first heater assembly 300.

The resistance of the heating element 604 increases as the width decreases. Therefore, in use, the heating element gets hotter along its length. This increases the temperature difference of the first and second central regions. Therefore, providing a heating element having such a temperature gradient allows for increased control of the vaporisation of the first and second compounds.

Figure 8:
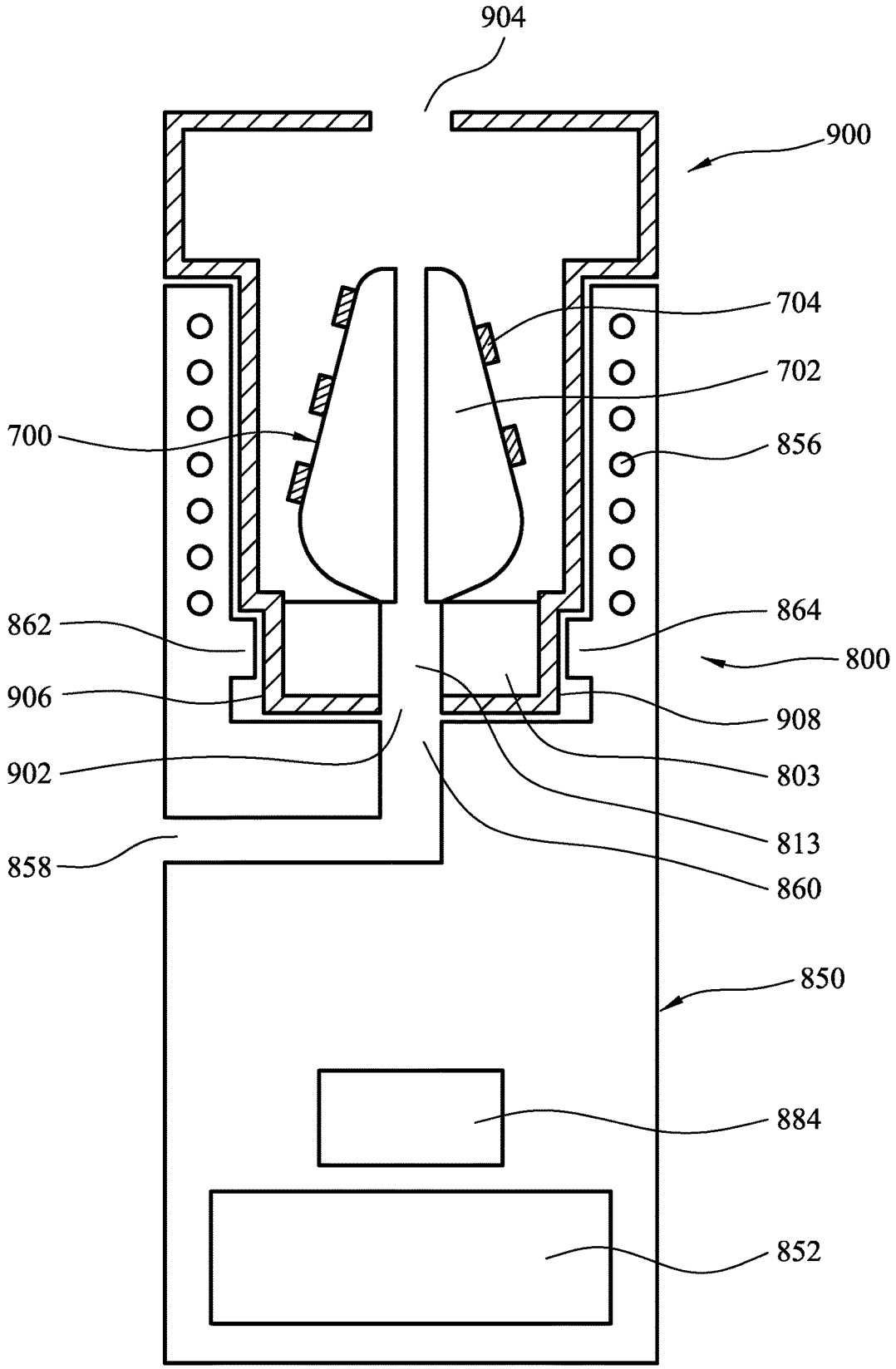
FIG. 8 shows a cross-sectional schematic view of a second aerosol-generating system.

FIG. 8 shows a schematic, cross-sectional view of a second aerosol-generating system 800. The aerosol-generating system 800 comprises an aerosol-generating device 850 and a cartridge 900 incorporating a second heater assembly 700. In this example, the aerosol-generating system 800 is an electrically operated smoking system.

The aerosol-generating device 850 is portable and has a size comparable to a conventional cigar or cigarette. The device 850 comprises a battery 852, such as a lithium iron phosphate battery, and a controller 854 electrically connected to the battery 852. The device 850 also comprises an induction coil 856 electrically connected to the battery 852. The device 850 also comprises an air inlet 858 and an air outlet 860 in fluid communication with the air inlet 858.

The cartridge 900 comprises an air inlet 902, an air outlet 904, and a second heater assembly 700. The air inlet 902 is in fluid communication with the air outlet 904. The heater assembly 700 is positioned downstream of the air inlet 902 and upstream of the air outlet 904. When the cartridge 500 is engaged with the aerosol-generating device 850, as shown in FIG. 8, the air outlet 860 of the device 850 is adjacent to the air inlet 802 of the cartridge 900. Thus, in use, when a user puffs on the air outlet 904 of the cartridge 900, air flows through the air inlet 858 of the device 850, then through the air outlet 860 of the device 850, then through the air inlet 902 of the cartridge 900, then past the heater assembly 700, then through the air outlet 904 of the cartridge 900.

In this system 800, the liquid aerosol-forming substrate comprises around 98% by weight glycerine and 2% by weight nicotine, though any suitable substrate could be used. At atmospheric pressure, nicotine has a boiling point of around 247 degrees centigrade and glycerine has a boiling point of around 290 degrees centigrade. Thus, when initially heating this liquid aerosol-forming substrate to form an aerosol, some systems may undesirably vaporise a disproportionately large amount of nicotine (which has the lowest boiling point of the compounds forming the substrate). This may lead to a less desirable aerosol being delivered to the user. This may also undesirably change the relative proportions of the compounds in the substrate over a longer time period. The present invention may eliminate or at least reduce these undesirable effects.

In FIG. 8, the cartridge 900 is engaged with the aerosol-generating device 850. In this example, the cartridge 900 is engaged with the aerosol-generating device 850 via apertures 906, 908 which form a snap-fit connection with corresponding protrusions 862, 864 on the aerosol-generating device 850.

The heater assembly 700 comprises a spiral shaped heating element 704 and a retention material 702 filling an interior volume defined by the spiral shaped element. This is a similar arrangement to the first heater assembly 300 described in relation to FIG. 1. The heating element 704 comprises a strip of a susceptor material. In this example, the susceptor material is aluminium, though any suitable susceptor material could be used.

The retention material 702 in this example is a capillary material having a fibrous structure. The capillary material is formed form polyester, though any suitable material could be used.

In use, a user puffs on the air outlet 704 of the cartridge 900. At the same time, the user presses a button (not shown) on the aerosol-generating device 850. Pressing this button sends a signal to the controller 854, which results in the battery 852 supplying a high frequency electrical current to the induction coil 856. This causes the induction coil 856 to create a fluctuating electromagnetic field. The heating element 704 is positioned within this field. Thus, this fluctuating electromagnetic field generates eddy currents and hysteresis losses in the heating element 704. The heating element 704 is therefore inductively heated. In other examples, an air flow sensor, or pressure sensor, is located in the device 850 and electrically connected to the controller 854. The air flow sensor, or pressure sensor, detects that a user is puffing on the air outlet 904 of the cartridge 900 and sends a signal to the controller 854 to supply the high frequency electrical current to the induction coil 856, thereby heating the heating element 904. In these examples, there is therefore no need for the user to press a button to heat the heating element 704.

As the heating element 704 is heated, areas of higher temperature and areas of lower temperature are created in the retention material 702. The creation of areas of higher temperature and areas of lower temperature causes compounds of the liquid aerosol-forming substrate with higher boiling points and lower boiling points in the retention material 602 to be vaporised simultaneously. This effect was described above in relation to the aerosol-generating system shown in FIG. 1.

As the user puffs on the air outlet 904 of the cartridge 900, air is drawn into the air inlet 858. This air then travels through a channel 813 defined through the reservoir 803 and then through airflow path 806 defined through the retention material 702 and towards the air outlet 904. This flow of air entrains the vapour formed by the heating of liquid aerosol-forming substrate in the retention material 703. This entrained vapour then cools and condenses to form an aerosol. This air then travels towards the air outlet 904. This flow of air entrains the vapour formed by heating of the liquid aerosol-forming substrate by the heating element 704. This entrained vapour then cools and condenses to form an aerosol. This aerosol is then delivered to the user via the air outlet 904.

Figure 9:
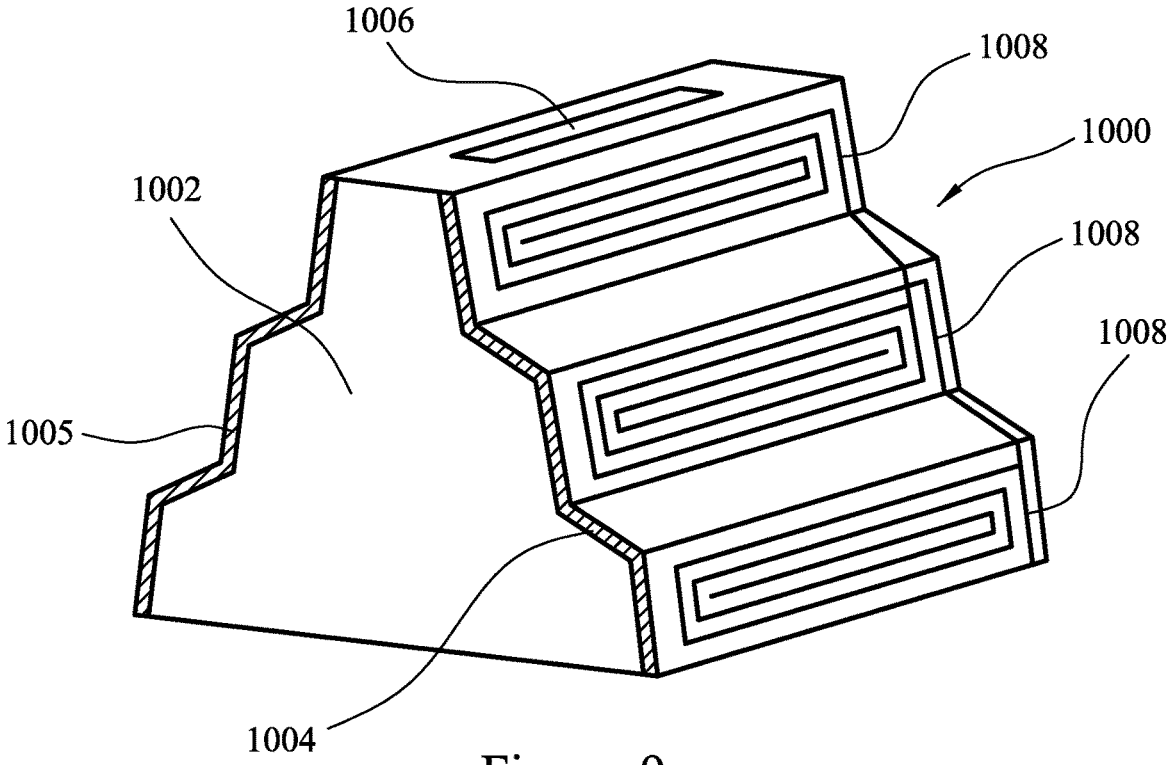
FIG. 9 shows a fifth heater assembly comprising two heating elements, the heating elements comprising inductor coils.

FIG. 9 shows a sixth heater assembly 1000 that uses an alternative inductive heating mechanism. The sixth heater assembly 1000 comprises a first heating element 1004 and a second heating element 1005. Both the first heating element 1004 and the second heating element 1005 comprise an electrically insulating substrate made of polyamide. The electrically insulating substrate has a stepped shape comprising three steps. The steps are configured such that the heating elements get progressively closer together. Each heating element 1004,1005 comprises an induction coil 1008 in the form of a flat spiral on each of the steps. The induction coil 1008 is attached to, or embedded in, the electrically insulating substrate.

Between the first and second heating elements 1004, 1005 is defined an interior volume which is filled with retention material 1002. The cross-sectional area of the interior volume decreases along a longitudinal axis as a result of the stepped heating elements. The longitudinal axis is defined through the centre of the interior volume. An airflow path 1006 is defined through the centre of the retention material, parallel to the longitudinal axis. This is a similar arrangement to that shown in FIGS. 4 and 5. However, in this embodiment, inductor coils 1008 in the shape of flat spiral coils are formed on each of the heating elements.

Further, the retention material 1006 consists of a susceptor material. In this embodiment, the susceptor material consists of a foamed metal, but any suitable material can be used. The heating element comprising the induction coils are connected to a battery of an aerosol-generating system. This is not shown in FIG. 9.

In use, a signal is sent to a controller of the aerosol-generating system, which results in the battery supplying a high frequency electrical current to the induction coils 1008 of the heating elements 1004, 1005. This causes the induction coils 1008 to create a fluctuating electromagnetic field. The retention material 1006 consisting of susceptor material is positioned within this field. Thus, this fluctuating electromagnetic field generates eddy currents and hysteresis losses in retention material 1002. The retention material 1002 is therefore inductively heated.

The temperature of retention material 1002 depends on the magnetic flux density or the magnetic field strength of the alternating magnetic field. The magnetic flux density between the induction coils increases as the induction coils get closer together. Therefore, as described in relation to previous embodiments, the retention material is heated to different temperatures in different zones, corresponding to the different steps of the heating elements 1004,1005. A first central region of the retention material 1006 is heated to a different temperature than a second or third central region. This is not shown in FIG. 9.

Figure 10:
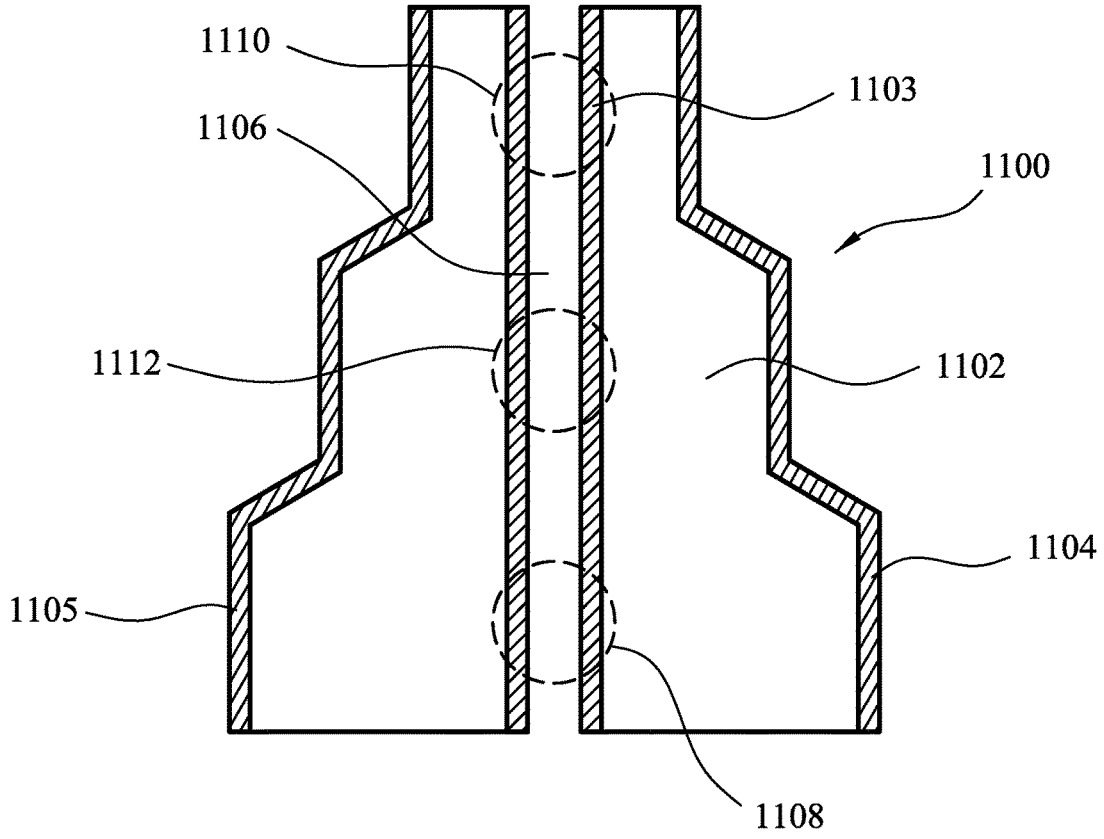

FIG. 10 shows a cross-sectional schematic view of a seventh heater assembly 1100. The seventh heater assembly 1100 comprises a first heating element 1104 and a second heating element 1105. As in the heater assembly 1000 of FIG. 9, both the first heating element 1004 and the second heating element 1005 comprise an electrically insulating substrate made of polyamide. The electrically insulating substrate of both the first heating element 1104 and the second heating element 1105 is stepped and comprises three steps configured such that the heating elements get progressively closer together. Each heating elements 1104,1105 comprises an induction coil (not shown in FIG. 10) in the form of a flat spiral on each of the steps.

Between the first and second heating elements 1004, 1005 is defined an interior volume which is filled with retention material 1102. The cross-sectional area of the interior volume decreases along a longitudinal axis as a result of the stepped heating elements. The longitudinal axis is defined through the centre of the interior volume. An airflow path 1006 is defined through the centre of the retention material 1102, parallel to the longitudinal axis. This is a similar arrangement to that shown in FIG. 9. However, in the embodiment shown in FIG. 10, the retention material does not consist of a susceptor material. Instead a susceptor material is provided in the form of a cylindrical mesh 1103 surrounding the airflow path 1106.

In use, a signal is sent to a controller of the aerosol-generating system (not shown in FIG. 10), which results in a battery supplying a high frequency electrical current to the induction coil of the heating elements 1004,1005. This causes the induction coil 1008 to create a fluctuating electromagnetic field. The retention material 1002 consisting of susceptor material is positioned within this field. Thus, this fluctuating electromagnetic field generates eddy currents and hysteresis losses in cylindrical mesh 1103. The cylindrical mesh 1103 is therefore inductively heated and that heat is conducted to the retention material 1102 to heat aerosol-forming substrate contained in that retention material 1102.

The temperature of retention material 1106 depends on the magnetic flux density or the magnetic field strength of the alternating magnetic field. The magnetic flux density between the inductor coils increases as the inductor coils get closer together. Therefore, as described in relation to previous embodiments, the retention material is heated to different temperatures in different central regions 1108, 1110, 1112, corresponding to the different steps of the heating elements 1104,1105.

The invention claimed is:

1. A heater assembly for an aerosol-generating system, the heater assembly comprising:

a retention material containing an aerosol-forming substrate in condensed form, the aerosol-forming substrate comprising a first compound and a second compound, the second compound having a higher boiling point than the first compound;

at least one airflow path defined through the retention material; and at least one heating element shaped to define an interior volume, the interior volume being filled with the retention material, wherein the interior volume has a cross-sectional area that decreases along a longitudinal axis, wherein the at least one airflow path passes through a first central region of the interior volume and a second central region of the interior volume, the first and the second central regions being spaced-apart along the longitudinal axis, and wherein a resistance of the at least one heating element increases along the longitudinal axis in a same direction that the cross-sectional area of the interior volume decreases.

2. The heater assembly according to claim 1, further comprising a heating element having a spiral shape.

3. The heater assembly according to claim 1, further comprising a first heating element and a second heating element, wherein an interior volume of the retention material is defined between the first heating element and the second heating element.

4. The heater assembly according to claim 3, wherein a separation between the first heating element and the second heating element decreases along the longitudinal axis in the same direction that the cross-sectional area of the interior volume decreases.

5. The heater assembly according to claim 1, wherein a minimum distance from the first central region to the heating element is greater than a minimum distance from the second central region to the heating element.

6. The heater assembly according to claim 1, wherein the at least one heating element is a resistive heating element.

7. The heater assembly according to claim 1, wherein the at least one heating element is a susceptor.

8. The heater assembly according to claim 1, wherein the retention material comprises a susceptor element and the at least one heating element forms or comprises an inductor coil configured to heat the susceptor element of the retention material.

9. The heater assembly according to claim 1, wherein the at least one airflow path comprises a first airflow path defined through the retention material that passes through the first central region in a direction perpendicular to the longitudinal axis.

10. An aerosol-generating system comprising the heater assembly according claim 1.

11. The aerosol-generating system according to claim 10, further comprising:

a power supply connectable to the heater assembly; and a controller to control power supplied to the heater assembly from the power supply.

12. The aerosol-generating system according to claim 10, further comprising an aerosol-generating device, wherein a cartridge is removably receivable in the aerosol-generating device.

13. A cartridge for an aerosol-generating system, the cartridge comprising a heater assembly according to claim 1.

14. A method of operating an aerosol-generating system, the aerosol-generating system comprising:

a retention material containing an aerosol-forming substrate in condensed form, the aerosol-forming substrate comprising a first compound and a second compound, the second compound having a higher boiling point than the first compound, at least one airflow path defined through the retention material, a heater assembly comprising at least one heating element shaped to define an interior volume, the interior volume filled with the retention material, a power supply, and a controller configured to control power supplied to the heater assembly from the power supply, wherein the interior volume has a cross-sectional area that decreases along a longitudinal axis, wherein the at least one airflow path passes through a first central region of the interior volume and a second central region of the interior volume, the first and the second central regions being spaced-apart along the longitudinal axis, and wherein a resistance of the at least one heating element increases along the longitudinal axis in a same direction that the cross-sectional area of the interior volume decreases; and the method comprising activating the at least one heating element to heat the retention material such that the first central region is heated to a different temperature than that of the second central region.

* * * * *